United States Patent [19]

Inoue et al.

[11] Patent Number: 5,051,336

[45] Date of Patent: Sep. 24, 1991

[54] NEGATIVE TYPE SILVER HALIDE PHOTOGRAPHIC MATERIAL AND METHOD FOR FORMING IMAGE USING THE SAME

[75] Inventors: Nobuaki Inoue; Senzo Sasaoka; Tetsuo Yoshida, all of Kanagawa, Japan

[73] Assignee: Fuji Photo Film Co., Ltd., Kanagawa, Japan

[21] Appl. No.: 522,400

[22] Filed: May 11, 1990

Related U.S. Application Data

[63] Continuation of Ser. No. 110,386, Oct. 20, 1987, abandoned.

[30] Foreign Application Priority Data

Oct. 20, 1986 [JP] Japan ..... 61-249161

[51] Int. Cl.[5] ..... G03C 1/28; G03C 1/10; G03C 1/34; G03C 5/29

[52] U.S. Cl. ..... 430/264; 430/265; 430/434; 430/564; 430/600; 430/603; 430/611; 430/613

[58] Field of Search ..... 430/264, 265, 434, 564, 430/611, 613, 600, 603, 949

[56] References Cited

U.S. PATENT DOCUMENTS 4,328,302 5/1982 Nishimura et al. ..... 430/264
4,452,882 6/1984 Akimura et al. ..... 430/267
4,681,836 7/1987 Inoue et al. ..... 430/264
4,705,738 11/1987 Balestru ..... 430/264
4,737,442 4/1988 Yagihara et al. ..... 430/264

*Primary Examiner*—Charles L. Bowers, Jr.
*Assistant Examiner*—Lee C. Wright
*Attorney, Agent, or Firm*—Sughrue, Mion, Zinn, Macpeak & Seas

[57] ABSTRACT

A negative type silver halide photographic material is disclosed. The material comprises a support having provided thereon at least one silver halide emulsion layer containing silver halide grains sensitized with gold and sulfur sensitizers, the emulsion layer or at least one other hydrophilic colloid layer containing at least one high contrast-imparting hydrazine derivative and at least one compound represented by the following general formula (I):

(I)

wherein Z represents N or C—X wherein X represents a substituted or unsubstituted alkyl or aryl group, Y represents a substituted or unsubstituted alkyl or aryl group, and M represents a hydrogen atom, a metallic atom, or ammonium which may be substituted.

9 Claims, No Drawings

NEGATIVE TYPE SILVER HALIDE PHOTOGRAPHIC MATERIAL AND METHOD FOR FORMING IMAGE USING THE SAME

This is a continuation of application Ser. No. 07/110,386, filed Oct. 20, 1987, now abandoned.

FIELD OF THE INVENTION

The present invention relates to a silver halide photographic material, more particularly to a negative type silver halide photographic material, for use in the field of photomechanical processing and able to form rapidly a superhigh contrast image when treated with a highly stable treating solution.

BACKGROUND OF THE INVENTION

It is known that a photographic image of very high contrast can be formed using a certain type of silver halide. Methods for forming such a photographic image are known in the field of photomechanical processes.

For example, a method is known for obtaining a line original or a dot image having an image part and a non-image part distinguished clearly and having a high contrast and a high optical density, which method comprises treating a lith type silver halide photographic material comprising silver chlorobromide (containing at least 50 mol % of silver chloride) with a hydroquinone developing solution having a very low effective concentration, usually 0.1 mol/l or less, of sulfite ions. However, the sulfite concentration in the developing solution of the method is so low that the quality of the image formed by development with the developing solution is very unreliable due to air oxidation, so that at present various endeavors are being undertaken in an effort to stabilize the activity of the developing solution.

Therefore, an image-forming system has been demanded which can alleviate the defect of unreliable image formation inherent in such a development method (lith development system) as mentioned above, and which can provide superhigh contrast photographic characteristics through development with a processing solution having good storage stability. As disclosed in U.S. Pat. Nos. 4,166,742, 4,168,977, 4,221,857, 4,224,401, 4,243,739, 4,272,606, and 4,311,781, there have been proposed systems to form superhigh contrast negative images having a Y value exceeding 10 by treating a surface latent image-type silver halide photographic material containing a specified acylhydrazine compound with a developing solution having a pH value of 11.0–12.3, said developing solution containing a sulfite preservative at a concentration of 0.15 mol/l or more; and having good storage stability.

However, the new image-forming system has defects. For example, when a large number of films are treated, the sensitivity, $\gamma$, or the maximum density of photographic material is lowered because the pH value of developing solution is reduced or bromine ions in the developing solution are increased. Further, the system also has such defects that, if the concentration of sulfite as a preservative in the developing solution is markedly decreased or the pH value of developing solution is increased because of fatigue of the developing solution with passage of time while a small number of films are treated with the developing solution, many black peppers are formed and, at the same time, the maximum density is reduced. To alleviate these defects, a method to increase the amount of replenisher for the developing solution can be adopted. The method, however, has problems such as an increase in cost, a waste solution, and the like. A system free from a fluctuation in sensitivity, a lowering of $D_{max}$, and formation of black peppers without the necessity of increased amount of replenisher has been demanded strongly.

SUMMARY OF THE INVENTION

Therefore, a first object of the invention is to provide a very-high sensitivity, very-high contrast silver halide photographic material having a $\gamma$ value exceeding 10 of image when treated with a stable developing solution.

A second object of the invention is to provide a silver halide photographic material having a small lowering in sensitivity, in $\gamma$, and in $D_{max}$ when treated with a developing solution having a lowered pH value or an increased concentration of bromine ions caused by treatment of a large number of films.

A third object of the invention is to provide a silver halide photographic material free from formation of black peppers and a lowering of $D_{max}$ when treated with a developing solution having a markedly reduced concentration of sulfite and an increased pH value because of fatigue of developing solution with passage of time.

The above-mentioned objects of the invention have been attained by a negative type silver halide photographic material, comprising a support having thereon at least one silver halide emulsion layer containing silver halide grains sensitized with gold and sulfur sensitizers, and having at least one high contrast-imparting hydrazine derivative and at least one compound represented by the general formula (I) as set forth below contained in the above-mentioned emulsion layer or in at least one other hydrophilic colloid layer, and by a method for forming a super-high contrast negative image comprising imagewise exposing the silver halide photographic material, and then developing the material with a developing solution containing sulfite ions in an amount of at least 0.15 mol per liter and having a pH of 10.5 to 12.3:

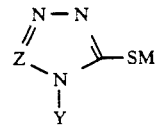

(I)

wherein Z represents N or C-X wherein X represents a substituted or unsubstituted alkyl or aryl group, Y represents a substituted or unsubstituted alkyl or aryl group, and M represents a hydrogen atom, a metallic atom, or ammonium which may be substituted.

DETAILED DESCRIPTION OF THE INVENTION

The substituents for the substituted alkyl group, the substituted aryl, and the substituted ammonium groups represented by X, Y, and M include a halgen atom, a carboxyl group, and a sulfonic acid group, etc.

Of groups represented by X, a substituted or unsubstituted alkyl group having 1 to 30 carbon atoms, a substituted or unsubstituted phenyl group having 6 to 30 carbon atoms, and a substituted or unsubstituted naphthyl group having 10 to 30 carbon atoms are preferred.

Of groups represented by Y, a substituted or unsubstituted alkyl group having 1 to 30 carbon atoms, and a substituted or unsubstituted aryl group having 6 to 30 carbon atoms are preferred, and a substituted or unsubstituted phenyl group having 6 to 30 carbon atoms or a substituted or unsubstituted naphthyl group having 10 to 30 carbon atoms are particularly preferred.

The metallic atom for M of the general formula (I) preferably is a sodium atom or a potassium atom.

Specific examples of compounds represented by the general formula (I) which are used in the invention will be shown hereinafter. However, the invention is not limited to these compounds.

(I)-1

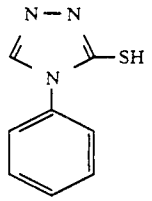

(I)-2

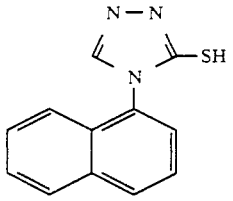

(I)-3

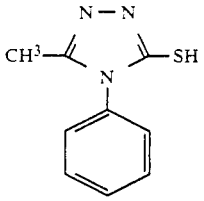

(I)-4

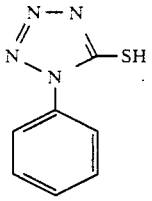

(I)-5

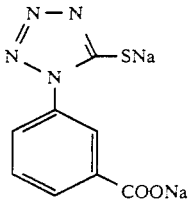

(I)-6

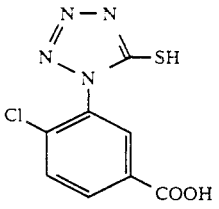

-continued (I)-7

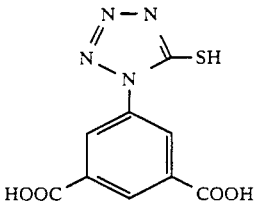

(I)-8

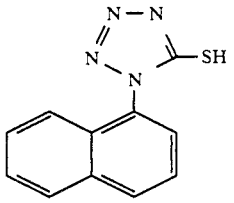

(I)-9

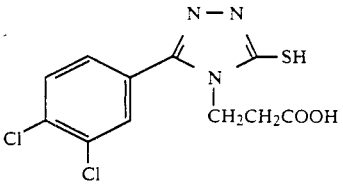

(I)-10

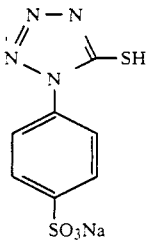

(I)-11

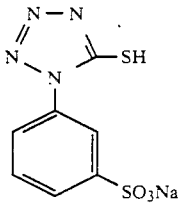

(I)-12

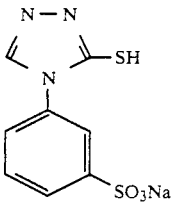

(I)-13

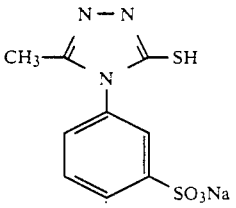

-continued (I)-14

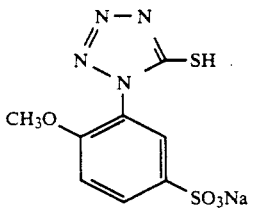

(I)-15

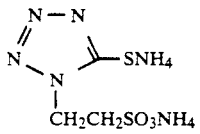

(I)-16

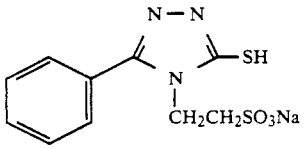

(I)-17

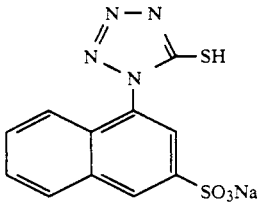

(I)-18

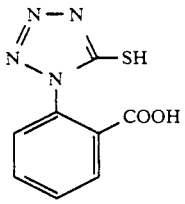

(I)-19

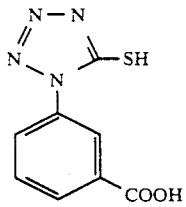

(I)-20

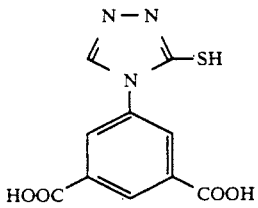

(I)-21

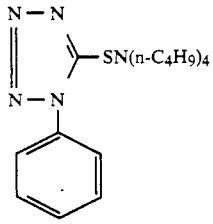

-continued (I)-22

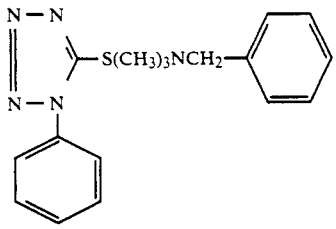

(I)-23

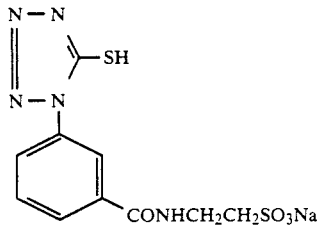

(I)-24

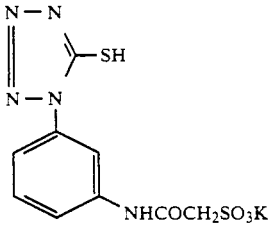

(I)-25

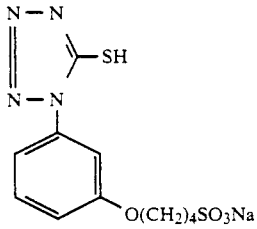

(I)-26

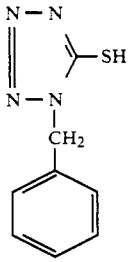

As well known in general, compounds represented by the general formula (I) can be synthesized readily by a method using an isothiocyanate as a starting material.

Methods for synthesis of compounds represented by general formula (I) are known and can be found, for example, in the following references which are hereby incorporated by reference.

U.S. Pat. Nos. 2,585,388, and 2,541,924; Japanese Patent Publication No. 21842/67, Japanese Patent Application No. 50169/78 (the term "OPI" as used herein means a "published unexamined Japanese patent application"), British Patent No. 1,275,701; D.A. Berges et al, *Journal of Heterocyclic Chemistry,* vol 15, p.981(1978); *The Chemistry of Heterocyclic Chemistry,* "Imidazole and Derivatives, part 1", p.336-339; *Chemical Abstract,* 58, No. 7921(1963), p.394; E. Hoggarth, *Journal of Chemical Society,* volume of 1949, pp.1160-1167; and S.R. Sandler and W.Karo, *Organic*

*Functional Group Preparations,* Academic Press, 1968, pp.312–315

Examples of silver halide photographic material containing hydrazine and, in addition, mercapto azoles such as the general formula (I) are disclosed in the specification of Japanese Patent Application Nos. 67843/81, 191245/83, 83028/85, and 47944/86, and the like but the above-mentioned effects are not referred to. The present invention concerns the discovery that very stable photographic performance, in spite of fluctuations in properties of processing solution, is obtained in a silver halide emulsion which has been subjected to gold sensitization and, at the same time, sulfur sensitization. An emulsion so prepared has demonstrated an effect beyond expectations.

As examples of hydrazine derivatives used in the invention, there may be mentioned compounds represented by the general formula (II) as set forth below.

As hydrazine derivatives used in the invention, those represented by the general formula (II) as set forth below are preferred:

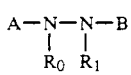

(II)

wherein A represents a substituted or unsubstituted aliphatic or aromatic group; B represents a formyl group, an acyl group, an alkylsulfonyl group, an arylsulfonyl group, an alkylsulfinyl group, an arylsulfinyl group, a carbamoyl group; a sulfamoyl group, an alkoxycarbonyl group, an aryloxycarbonyl group, a sulfinamoyl group, an alkoxysulfonyl group, a thioacyl group, a thiocarbamoyl group, or a heterocyclic group; and both $R_0$ and $R_1$ represent hydrogen atoms or one of $R_0$ and $R_1$ represents a hydrogen atom and the other represents a substituted or unsubstituted alkylsulfonyl group, a substituted or unsubstituted arylsulfonyl group, or a substituted or unsubstituted acyl group.

However, B, $R_1$ and the nitrogen atom to which they are bonded may form the partial structure —N=C< of hydrazone.

Next, the general formula (II) will be described in detail.

In the general formula (II), aliphatic groups represented by A are preferably the ones of 1 to 30 carbon atoms and, especially preferably, linear, branched, or cyclic alkyl groups of 1 to 20 carbon atoms. The branched alkyl group may be cyclized to form a saturated heterocyclic ring containing one or more hetero atoms. The alkyl groups may have a substituent group such as an aryl group, an alkoxy group, a sulfoxylic group, a sulfonamide group, a carboxylic acid amide group, or the like.

As the examples of the aliphatic group, there may be mentioned, a t-butyl group, an n-octyl group, a t-octyl group, a cyclohexyl group, a pyrrolidyl group, an imidazolidyl group, a tetrahydrofuryl group, a morpholino group, and the like.

The aromatic group represented by A in the general formula (II) is preferably a monocyclic or bicyclic aryl group or an unsaturated heterocyclic group. The unsaturated heterocyclic group may be condensed with a monocyclic or bicyclic aryl group to form a heteroaryl group.

The aromatic group includes, for example, a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, and the like, and of these, the aromatic group containing a benzene ring is preferred.

The especially preferred aromatic groups as A are benzene and naphthalene.

Aryl groups or unsaturated heterocyclic groups represented by A may have a substituent group. As representative substituent groups, there may be mentioned linear, branched, or cyclic alkyl groups (preferably, with 1 to 20 carbon atoms), aralkyl groups (preferably, monocyclic or bicyclic groups whose alkyl moiety has a carbon atom number of 1 to 3), alkoxy groups (preferably, with 1 to 20 carbon atoms), substituted amino groups (preferably, substituted with an alkyl group of 1 to 20 carbonatoms), acylamino groups (preferably, with 2 to 30 carbon atoms), sulfonamide groups (preferably, with 1 to 30 carbon atoms), ureido groups (preferably, with 1 to 30 carbon atoms), and the like.

A in the general formula (II) may additionally have a ballast group incorporated into it which ballast group is commonly used to render a photographic additive such as a coupler or the like non-diffusible. The ballast group is a group relatively inactive with respect to photographic properties and has a carbon atom number of 8 and over. The ballast group can be selected from among alkyl groups, alkoxy groups, a phenyl group, alkyl phenyl groups, a phenoxy group, alkylphenoxy groups, and the like.

A in the general formula (II) may have a group incorporated into it which group strengthens adsorption to the surface of silver halide grains. As such a group, there may be mentioned groups such as a thiourea group, heterocyclic thioamide groups, mercapto heterocyclic groups, triazole groups, and the like which are disclosed in U.S. Pat. Nos. 4,385,108 and 4,459,347, in Japanese Patent Application (OPI) Nos. 195233/84, 200231/84, 201045/84, 201046/84, 201047/84, 201048/84, 201049/84, 179734/85, and 170733/86, and U.S. patent application Ser. No.826,153.

B represents preferably a formyl group, an acyl group (such as an acetyl group, a propionyl group, a trifluoroacetyl group, a chloroace-tyl group, a benzoyl group, a 4-chlorobenzoyl group, a pyruvoyl group, a methoxalyl group, a methyloxamoyl group, or the like), an alkyl sulfonyl group (such as a methane sulfonyl group, a 2-chloroethane sulfonyl group, or the like), an aryl sulfonyl group (such as a benzene sulfonyl group, or the like), an alkyl sulfinyl group (such as a methane sulfinyl group or the like), an aryl sulfinyl group (such as a benzene sulfinyl group or the like), a carbamoyl group (such as a methylcarbamoyl group, a phenylcarbamoyl group, or the like), a sulfamoyl group (such as a dimethylsulfamoyl group, or the like), an alkoxycarbonyl group, such as a methoxycarbonyl group, a methoxyethoxycarbonyl group, or the like), an aryloxycarbonyl group (such as a phenoxycarbonyl group, or the like), a sulfinamoyl group (such as a methylsulfinamoyl group, or the like), an alkoxy sulfonyl group (such as a methoxy sulfonyl group, an ethoxy sulfonyl group, or the like), a thioacyl group (such as a methylthiocarbonyl group, or the like), a thiocarbamoyl group (such as a methylthiocarbamoyl group, or the like), or a heterocyclic ring group (such as a pyridine ring, or the like).

A formyl group or an acyl group as B is, in particular, preferred.

B in the general formula (II) together with $R_1$ and a nitrogen atom to which B and $R_1$ are bonded may form the partial structure

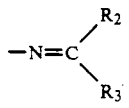

of hydrazone.

In the above formula, R2 represents an alkyl group, an aryl group, or a heterocyclic ring group, and $R_3$ represents a hydrogen atom or an alkyl group, an aryl group, or a heterocyclic ring group.

One of $R_0$ and $R_1$ is a hydrogen atom, and the other is a hydrogen atom, an alkyl sulfonyl group having 20 carbon atoms or less, an aryl sulfonyl group having 20 carbon atoms or less (preferably, a phenyl sulfonyl group or a phenyl sulfonyl group substituted so that the sum of substituent constants of Hammett becomes −0.5 or more), an acyl group having 20 carbon atoms or less (preferably, a benzoyl group, a benzoyl group substituted so that the sum of substituent constants of Hammett becomes −0.5 or more, or an unsubstituted or substituted, linear, branched or cyclic aliphatic acyl group (wherein, as the substituent group, there may be mentioned, for example, halogen atoms, ether groups, sulfonamide groups, carboxylic acid amide groups, hydroxyl group, carboxylic group, sulfonic acid group, and the like).

It is most preferred that both $R_0$ and $R_1$ are hydrogen atoms.

Specific examples of compounds represented by the general formula (II) will be shown hereinafter. However, the invention is not limited to these compounds.

(II)-1

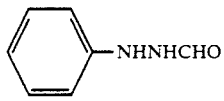

(II)-2

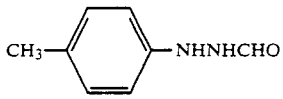

(II)-3

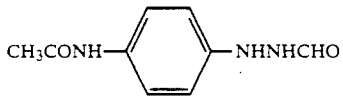

(II)-4

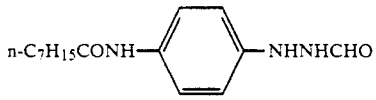

(II)-5

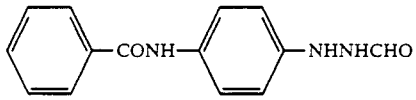

(II)-6

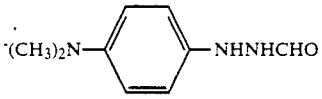

(II)-7

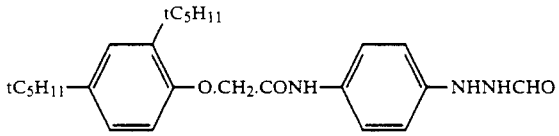

(II)-8

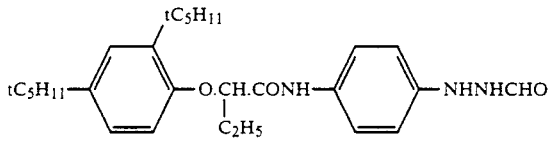

(II)-9

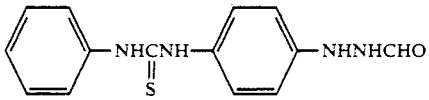

(II)-10

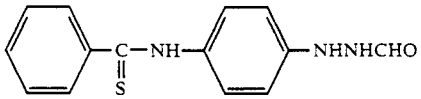

-continued
(II)-11
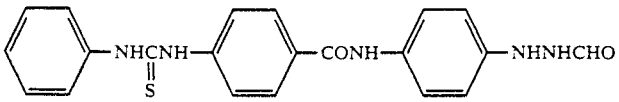
(II)-12
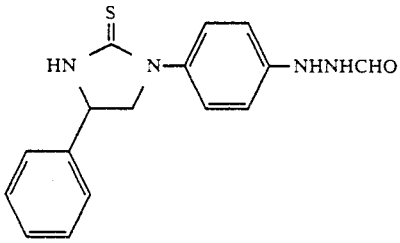
(II)-13
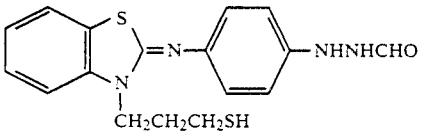
(II)-14
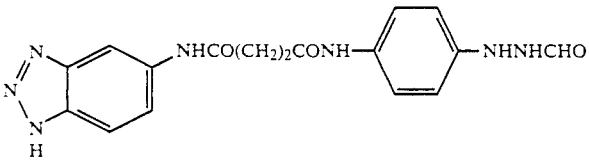
(II)-15
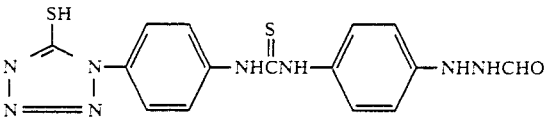
(II)-16
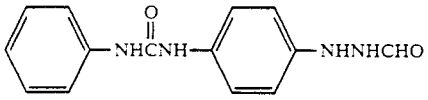
(II)-17
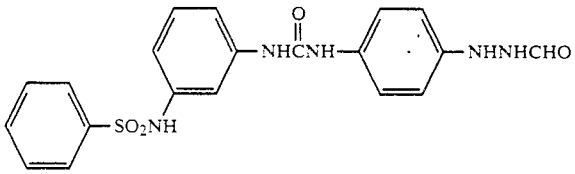
(II)-18
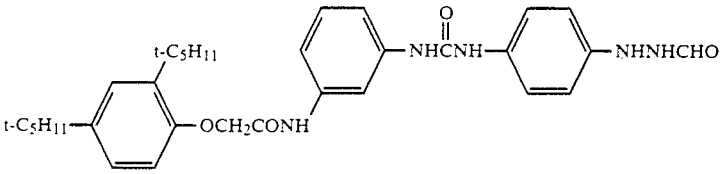
(II)-19
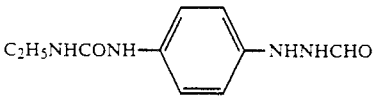
(II)-20
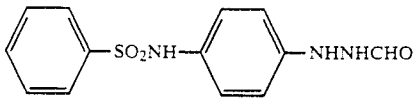

-continued
(II)-21
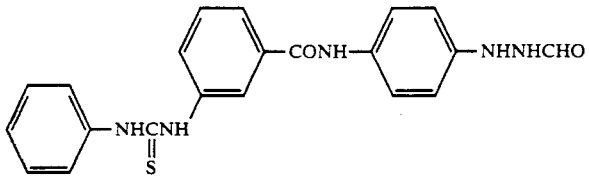
(II)-22
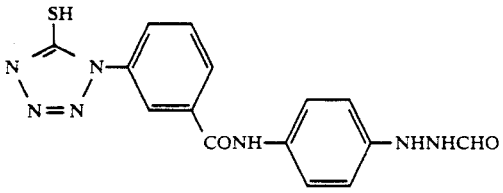
(II)-23
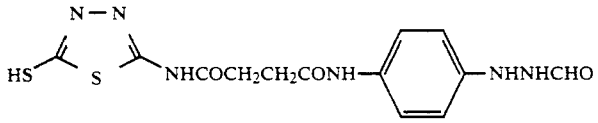
(II)-24
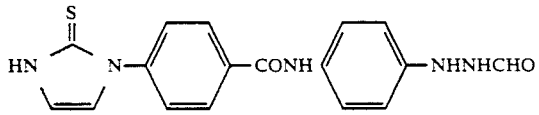
(II)-25
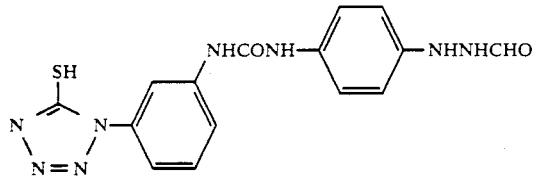
(II)-26
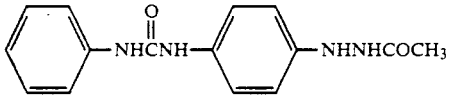
(II)-27
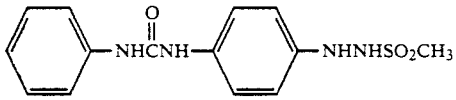
(II)-28
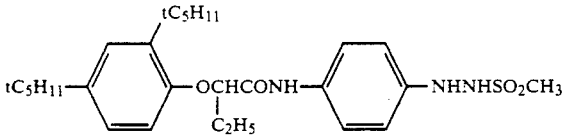
(II)-29
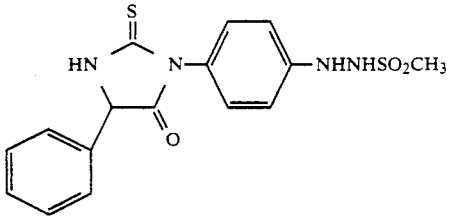
(II)-30
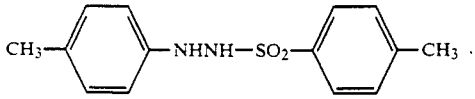

-continued
(II)-31
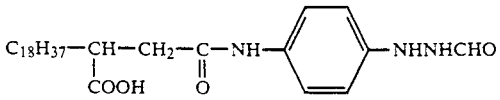
(II)-32
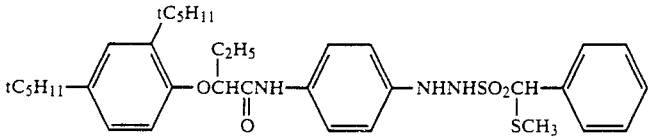
(II)-33
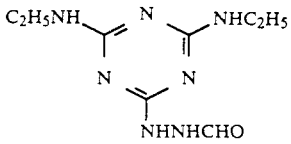
(II)-34
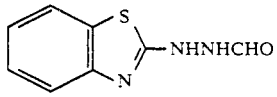
(II)-35
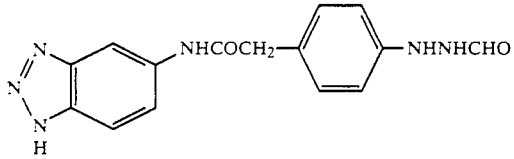
$n\text{-}C_{12}H_{25}—NHNHCHO$ (II)-36
(II)-37
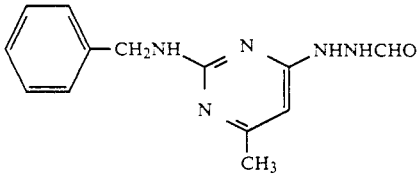
(II)-38
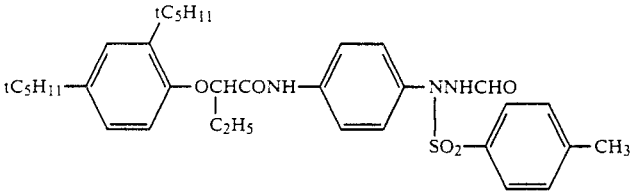
(II)-39
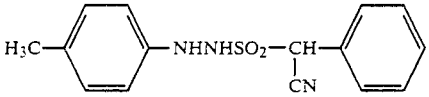
(II)-40
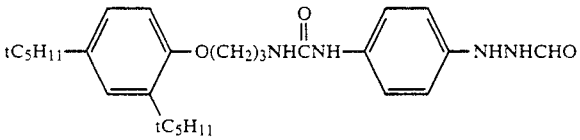
(II)-41
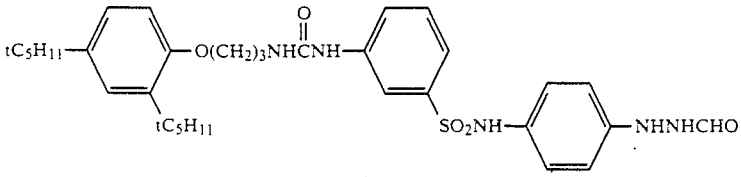

-continued (II)-42

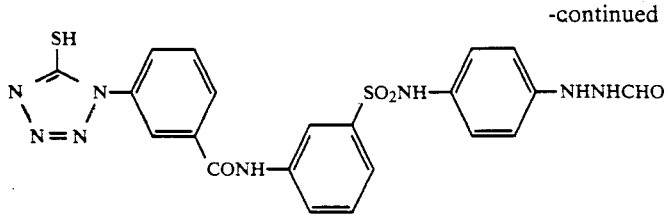

As the hydrazine derivative used in the present invention, in addition to the above-mentioned ones, those disclosed in *Research Disclosure,* Item 23516 (Nov. 1983, page 346), in literatures cited in the same, in U.S. Pat. Nos. 4,080,207, 4,269,929, 4,276,364, 4,278,748, 4,385,108, 4,459,347, 4,560,638, and 4,478,928, in British Patent No. 2,011,391B, and in Japanese Patent Application (OPI) No. 179734/85 can be used.

It is preferred that compounds represented by the general formula (I) and by the general formula (II) are contained in an amount of $1\times10^{31\ 6-}5\times10^{-2}$ mol per mol of total silver halide each, and the specially preferred amount added is $1\times10^{-5}$ to $2\times10^{-2}$ mol per mol of total silver halide each.

The compounds represented by the general formulae (I) and (II) may be contained in the same or different layer of the photographic material. Preferably the compounds represented by the general formulae (I) and (II) are contained in the same layer.

To incorporate compounds represented by the general formula (I) and by the general formula (II) into a photographic material, they may be added to a silver halide emulsion (such as an emulsion comprising coarse grains, an emulsion comprising fine grains, or the like) or to a hydrophilic colloid solution as an aqueous solution of these compounds if they are water soluble or as a solution of these compounds in a water miscible organic solvent such as an alcohol (for example, methanol or ethanol), an ester (for example, ethyl acetate), or a ketone (for example, acetone) if they are insoluble in water.

If they are added to a silver halide emulsion, the addition can be carried out at any time from the beginning of chemical ripening of the emulsion to the coating of the emulsion. However, it is preferred to add the compounds after the completion of chemical ripening, and it is especially preferred to add them to a coating solution ready for application.

The silver halide composition of the silver halide emulsion used in the invention is not especially limitated, and it may comprise any one of silver chloride, silver bromide, silver chlorobromide, silver iodobromide, silver iodochloride, and silver iodochlorobromide. The preferred silver halide composition is silver chlorobromide and silver, iodochlorobromide. A preferred content of silver chloride is 50 mol % or more but less than 80 mol %. If silver iodide is used, its content is 5 mol % or less, preferably 2 mol % or less.

As a method to prepare a silver halide emulsion used in the invention, various known methods in the field of preparing silver halide photographic material can be used. The silver halide emulsion can be prepared by use of methods described, for example, in P.Glafkides, *Chimie et Physique Photographique* (Paul G.F.Duffin), 1967, in G. F. Duffin, *Photographic Emulsion Chemistry* (The Focal Press), 1966, and in V. L. Zelikman et al, *Making and Coating Photographic Emulsion* (The Focal Press), 1964.

It is preferred that a silver halide used in the invention contains a rhodium salt or an iridium salt and it is especially preferred that it contains both of them. The rhodium salt includes rhodium trichloride, ammonium hexachlororhodate(III), and the like. The rhodium salt may be added at any time before completion of the first ripening when an emulsion is prepared in the invention. However, it is preferred to add it during the formation of silver halide grains and it is further preferred to add it to an aqueous solution of halogen salt so that it is distributed uniformly from the inside to the surface in silver halide grains. The amount added is $1\times10^{31\ 8}$ to $8\times10^{-6}$ mol, preferably $1\times10^{-7}$ to $5\times10^{-6}$ mol per mol of silver. The iridium salt includes iridium trichloride, iridium tetrachloride, potassium hexachloroiridate (III), potassium hexachloroiridate (IV), ammonium hexachloroiridate (III), and the like. The amount added is preferably $1\times10^{-8}$ to $1\times10^{-5}$ mol per mol of silver, and it is preferred to add it in the same way as in the above-mentioned rhodium salt.

It is preferred that silver halide grains used in the invention are fine grains having a grain size of 0.7 μm or less, and even more preferred is a grain size of 0.5 μm or less. The grain size distribution is preferably monodisperse, and at least 90% in number of all grains has the grain diameter preferably in a range of the average grain diameter ±40 % and further preferably in a range of the average grain diameter ±20 %.

Silver halide grains in photographic emulsion may have a regular crystalline form such as a cube or an octahedron, an irregular form such as a sphere or a plate, or a composite form of these crystalline forms.

As a reaction form to react a water-soluble silver salt for example, an aqueous solution of silver nitrate) with a water-soluble halogen salt, any one of a single-jet process, a double-jet process and a process comprising a combination of those may be used. As one form of the double-jet process, a process to maintain pAg in a solution phase in which a silver halide is formed at a constant level, that is, a controlled double jet process, can be used. Further, it is also possible to form silver halide grains using a so-called solvent for silver halides such as ammonia, thioether, a tetra-substituted thiourea, or the like.

With the controlled double jet process and with a grain forming process using a solvent for silver halide grains, it is easy to prepare a silver halide emulsion having a regular crystalline form and narrow grain size distribution, so that the above-mentioned two processes are a preferred means to prepare an emulsion used in the invention.

It is essential for the silver halide emulsion of the invention to subject sulfur sensitization and, at the same time, gold sensitization.

As a sulfur sensitizer used in the invention, in addition to a sulfur compound contained in gelatin, various sulfur compounds such as thiosulfates, thioureas, thiazoles, rhodanines, and the like can be used. Specific examples of the sulfur sensitizer are sulfur compounds as described in U.S. Pat. Nos. 1,574,944, 2,278,947, 2,410,689, 2,728,668, 3,501,313, and 3,656,955. The preferred sulfur compounds are thiosulfates and thiourea compounds.

The gold sensitizers used in the invention are various gold salts, and they include potassium chloroaurite, potassium aurithiocyanate, potassium chloroaurate, auric trichloride, and the like. Specific examples of the gold sensitizer are described in U.S. Pat. Nos. 2,399,083 and 2,642,361.

The preferred amounts of sulfur sensitizer and gold sensitizer added are $10^{-2}$ to $10^{-7}$ mol, preferably $1\times10^{-3}$ to $1\times10^{-5}$ mol per mol of silver each.

The molar ratio of sulfur sensitizer to gold sensitizer is 1:3-3:1, preferably 1:2-2:1.

A photographic emulsion used in the invention may be spectrally sensitized with a methine dye or the like. The dyes used for this purpose include cyanine dyes, melocyanine dyes, complex cyanine dyes, complex melocyanine dyes, holopolar cyanine dyes, hemicyanine dyes, styryl dyes, and hemioxonole dyes. Especially useful dyes are the ones belonging to cyanine dyes, melocyanine dyes, and complex melocyanine dyes. Any nucleus usually utilized for cyanine dyes as a basic heterocyclic nucleus can be utilized in these dyes. That is, pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, and the like; nuclei having an alicyclic hydrocarbon ring fused with the above-mentioned nucleus; and nuclei having an aromatic hydrocarbon ring fused with the above-mentioned nucleus, that is, indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, quinoline nucleus, and the like can be applied. These nuclei may have a substituent group attached to a carbon atom.

As a nucleus having ketomethylene structure, a 5-membered or 6-membered heterocyclic nucleus such as pyrazoline-5-one nucleus, thiohidantoin nucleus, 2-thioxazolidine-2,4-dione nucleus, thiazolidine-2,-4 -dione nucleus, rhodanine nucleus, or thiobarbitulic acid nucleus can be utilized for melocyanine dyes or complex melocyanine dyes.

Useful sensitizing dyes are disclosed, for example, in West German Patent No.929,080, in U.S. Pat. Nos. 2,231,658, 2,493,748, 2,503,776, 2,519,001, 2,912,329, 3,656,959, 3,672,897, and 3,694,217, in British Patent No.1,242,588, in Japanese Patent Publication No.14030/69, and in Japanese Patent Application (OPI) Nos.137133/78, 45015/80, and Japanese Patent Application No. 79533/86.

These sensitizing dyes may be used in the form of a single dye or of a combination of two or more dyes, and a combination of dyes is often used with the aim of supersensitization. A substance which is a dye having no spectral sensitization actions by itself or a substance absorbing substantially none of visible light and shows supersensitization when combined with a sensitizing dye may be contained in the photographic emulsion.

Useful sensitizing dyes, combinations of dyes which show supersensitization, and substances showing supersensitization are mentioned, in addition to the above-mentioned literature, in *Research Disclosure,* Vol.176, No.17643 (Dec.1978), p.23, IV Items A-J.

A combination with sensitizing dyes having no absorption maximum in a visible light region which are mentioned in Japanese Patent Application (OPI) No.124831/86 is specially useful.

Sensitizing dyes can be added to a photographic emulsion at any time in the manufacturing process of the emulsion, and also can be added to the photographic emulsion at any time before the manufactured emulsion is coated on the support. As the example of a time, a sensitizing dye is added in the former case, there may be mentioned when silver halide grains are formed, when they are physically ripened, and when they are chemically ripened.

A photographic material used in the invention may contain a water-soluble dye as a filter dye or for various purposes of preventing irradiation, etc. The water-soluble dye includes benzylidene dyes, oxonole dyes, melocyanine dyes, cyanine dyes and azo dyes. Of these, benzylidene dyes, oxonole dyes, hemioxonole dyes, and melocyanine dyes are particularly useful. Specific examples of the dyes usable are disclosed in British Patent Nos.584,609 and 1,177,429, in Japanese Patent Application (OPI) Nos.85130/73, 79620/74, 114420/74, 20822/77, 154439/84, and 208548/84, and in U.S. Pat. Nos. 2,274,782, 2,533,472, 2,956,879, 3,148,187, 3,177,078, 3,247,127, 3,540,887, 3,575,704, 3,653,905, and 3,718,472.

Various compounds in addition to the compounds of the general formula (I) can be contained in the photographic material of the invention with the purpose of preventing fog formation or of stabilizing the photographic performance of photographic material in the manufacturing process of photographic material, when the material is stored, or in the photographic treatment of the material. Many compounds known as an antifoggant or a stabilizer such as azoles, for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, and the like; mercaptopyrimidines; mercaptotriazines; thioketo compounds, for example, oxazoline thione; azaindenes, for example, triazaindenes, tetrazaindenes (in particular, 4-hydroxy substituted (1,3,3*a*,7)tetrazaindenes), pentazaindenes, and the like; benzene thiosulfonic acid; benzene sulfinic acid; and benzene sulfonamide can be added to the photographic material. Of these, benzotriazoles for example, 5-methyl-benzotriazole) and nitroindazoles (for example, 5-nitroindazole) are preferred. These compounds may be contained in a processing solution.

An inorganic or organic hardening agent may be contained in a photographic emulsion layer or other hydrophilic colloid layer of photographic material of the invention. For example, chromium salts (such as chromium alum, chromium acetate, and the like), aldehydes (such as glutaric aldehyde and the like), N-methylol compounds (such as dimethylol urea and the like), active vinyl compounds (such as 1,3,5-triacryloyl-hexahydro-s-triazine, 1,3-vinyl- sulfonyl-2-propanol, and the like), active halogen compounds (such as 2,4-dichloro-6-hydroxy-s-triazine, and the like), and mucohalogenic acids (such as mucochloric acids, and the like) can be added individually or as a combination of two or more compounds. Of these, active vinyl compounds described in Japanese Patent Application (OPI) Nos.41221/78, 57257/78, 162546/84, and 80846/85 and active halogen compounds described in U.S. Patent 3,325,287 are specially preferred.

Various surface active agents may be contained in photographic emulsion layers or other hydrophilic colloid layers of photographic materials prepared using the invention for various purposes of serving as a coating assistant, protecting from development of electrostatic charge, improving sliding property, emulsifying and dispersing, preventing adhesion, and improving photographic properties (for example, promoting development, high contrast, and sensitization).

As the surface active agent, there may be mentioned, for example, nonionic surface active agents such as saponin (steroid type), alkylene oxide derivatives (for example, polyethylene glycol, polyethylene glycol/-polypropylene glycol condensate, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and adducts of silicone with polyethylene oxide), glycidol derivatives (for example, polyglyceride of alkenyl succinic acid), aliphatic acid esters of polyhydric alcohols, alkyl esters of sugars, and the like; anionic surface active agents containing an acidic group such as a carboxylio group, a sulfo group, a phospho group, a sulfuric ester group, a phosphoric ester group, or the like, for example, alkyl carboxylic acid salts, alkyl sulfonic acid salts, alkylbenzene sulfonic acid salts, alkylnaphthalene sulfonic acid salts, alkyl sulfuric ester acid, alkyl phosphoric esters, N-acyl-N-alkyltaurines, sulfosuccinic esters, sulfoalkylpolyoxyethylene alkylphenyl ethers, polyoxyethylene alkylphosphoric esters, and the like; amphoteric surface active agents such as aminoacids, aminoalkyl sulfonic acids, aminoalkyl sulfuric or phosphoric esters, alkyl betaines, amine oxides, and the like; and cationic surface active agents such as alkylamine salts, aliphatic or aromatic quaternary ammonium salts, heterocyclic quaternary ammonium salts, for example, a pyridinium salt, an imidazolium salt, and the like, and phosphonium or sulfonium salts containing an aliphatic or heterocyclic ring.

A surface active agent especially preferably used in the invention is a polyalkylene oxide having a molecular weight of 600 or more such as disclosed in Japanese Patent Publication No. 9412/83.

If a surface active agent is used as an antistatic agent, those containing fluorine which are disclosed for example, in U.S. Pat. No. 4,201,586 and in Japanese Patent Application (OPI) No. 80849/85 are particularly preferred.

A water-soluble or sparingly water-soluble synthetic polymer can be dispersed in the photographic material used in the invention for the purpose of improving the dimensional stability. For example, a polymer having an alkyl (meth)acrylate, an alkoxy-alkyl (meth)acrylate, a combination of both, or a combination of the above-mentioned monomer with acrylic acid or methacrylic acid as the monomer component can be used.

It is preferred that a compound having an acid group is contained in the silver halide emulsion layers or other layers of photographic material of the invention. As the compound having an acid group, there may be mentioned organic acids such as salicyclic acid, acetic acid, ascorbic acid, and the like and polymers or copolymers having an acid monomer such as acrylic acid, maleic acid, or phthalic acid as a repeating unit. Such compounds are disclosed in greater detail in Japanese Patent Application (OPI) Nos. 223834/86, 228437/86, 25745/87, and 55642/87, hereby incorporated by reference. Of these compounds, an ascorbic acid is a preferred low molecular-weight compound, and a water dispersible latex of a copolymer comprising an acid monomer such as acrylic acid and a crosslinkable monomer such as divinyl benzene which has two or more unsaturated groups is, in particular, a preferred high molecular-weight compound.

It is advantageous to use gelatin as a binding agent or protective colloid in the photographic material but, alternatively, a hydrophilic synthetic polymer can be used. As gelatin, lime-treated gelatin, acid-treated gelatin, or the like can be used. Specific examples of gelatin are mentioned in *Research Disclosure,* Vol.176, No.17643(Dec.1978), Item IX.

In a photographic material of the invention, in addition to silver halide emulsion layers, hydrophilic colloid layers such as a surface protective layer, an intermediate layer, a filter layer, an antihalation layer, and like can be employed.

As a matting agent in a protective layer or the like, fine particles (having, for example, a diameter of 2 to 5 μm) of polymethyl methacrylate homopolymer, copolymer of methyl methacrylate and methacrylic acid, magnesium oxide, starch, silica, or the like can be used. Further, the above-mentioned surface active agent can be combined with the matting agent.

In the surface protective layer, in addition to a silicone compound and colloidal silica, a paraffin wax, a higher fatty acid ester and starch powder can be used as a lubricant.

Further, polyols such as trimethylol propane, pentane diol, and the like can be used as a plasticizer in a hydrophilic colloid layer.

To obtain superhigh contrast, high-sensitivity photographic characteristics using a silver halide photographic material of the invention, it is not necessary to use a conventional infectious developing solution or a high-alkalinity developing solution having a pH value near 13 such as disclosed in U.S. Pat. No. 2,419,975, as the invention enables achievement of these photographic characteristics with a stable developing solution.

Thus, a sufficiently superhigh contrast negative image can be obtained by treating the silver halide photographic material of the invention with a developing solution having a content of 0.15 mol/l and over of sulfite ions as a preservative and a pH value of 10.5–12.3, especially 11.0–12.0.

The developing agent used in a developing solution used in the invention is not specially limitated. From the viewpoint of characteristics to provide readily good dot quality, it is preferred that the developing agent includes dihydroxybenzenes. A combination of dihydroxy benzenes with 1-phenyl-3-pyrazolidones or of dihydroxy benzenes with p-aminophenols may also be used.

The dihydroxybenzene type developing agent used in the invention includes hydroquinone, chlorohydroquinone, methylhydroquinone, 2,3-dibromohydroquinone, and the like but hydroquinone is particularly preferred.

As 1-phenyl-3-pyrazolidone or its derivative which is a developing agent used in the invention, there may be mentioned 1-phenyl-3-pyrazolidone, 1-phenyl-4,4-dimethyl-3-pyrazolidone, 1-phenyl-4-methyl4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydtoxymethyl-3-pyrazolidone, and the like.

The p-aminophenol-containing developing agent used in the invention includes N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, and the like, and of the above, N-methyl-p-aminophenol is preferred.

It is preferred to use the developing agent usually in an amount of 0.05 mol/l to 0.8 mol/l. If dihydroxybenzenes are combined with 1-phenyl-3-pyrazolidones or p-aminophenols, it is preferred to use the former in an amount of 0.05 mol/l to 0.5 mol/l and the latter in an amount of 0.06 mol/l or less.

Sulfites as a preservative used in the invention include sodium sulfite, potassium sulfite, lithium sulfite, ammonium sulfite, sodium bisulfite, potassium metabisulfite, formaldehyde sodium bisulfite, and the like. The amount of sulfite used in 0.3 mol/l or more, particularly preferably 0.4 mol/l or more, and the upper limit of the amount is 2.5 mol/l, particularly preferably 1.2 mol/l.

As alkali agents used to set a pH value, pH adjusting agents or pH buffering agents such as sodium hydroxide, potassium hydroxide, sodium carbonate, potassium carbonate, tribasic potassium phosphate, and the like can be used.

As additives used in addition to the above-mentioned components of developing solution, there may be mentioned development restrainers such as boric acid, borax, sodium bromide, potassium bromide, and potassium iodide; organic solvents such as ethylene glycol, diethylene glycol, triethylene glycol, dimethylformamide, methyl cellosolve, hexyleneglycol, ethanol, and methanol; and antifoggants or black pepper inhibitors, for example, mercapto-containing compounds such as 1-phenyl-5-mercapto-tetrazole, sodium 2-mercaptobenzimidazole-5-sulfonate, and the like, indazole-containing compounds such as 5-nitroindazole and the like, and benztriazole-containing compounds such as 5-methylbenztriazole and the like. Further, a color toning agent, a surface active agent, an defoaming agent, a hard water softener, a hardening agent, an amino compound described in Japanese Patent Application (OPI) No. 106244/81, and the like can be contained in the developing solution, as required.

A compound disclosed as a silver stain inhibitor in U.S. Pat. No. 4,310,622, a compound disclosed as an agent to prevent uneven development in U.S. patent application Ser. No. 25,757 (filed on Mar. 13, 1987), and a compound disclosed as a dissolution assistant in Japanese Patent Application (OPI) No. 267759/86 can be also used in the developing solution used in the invention.

Boric acid mentioned in Japanese Patent Application No.28708/86, and saccharides (for example, saccharose), oximes (for example, acetoxime), phenols (for example, 5-sulfosalicylic acid), and tribasic phosphates (for example, sodium phosphate and potassium phosphate) mentioned in Japanese Patent Application (OPI) No. 93433/85 can be used as a buffering agent in a developing solution used in the invention. Of these, boric acid is preferably used.

A fixer is preferredly an aqueous solution containing, in addition to a fixing agent, a hardening agent (for example, a water-soluble aluminum compound), acetic acid, and a dibasic acid (for example, tartaric acid, citric acid, or the salt thereof), as required, and it has a pH value of 3.8 or higher, preferably of 4.5 to 5.5.

The water-soluble aluminum compound working mainly as a hardening agent in a fixer is a compound conventionally employed as a hardening agent in an acid hardening fixer and it includes, for example, aluminum chloride, aluminum sulfate, potassium alum, and the like.

As the above-mentioned dibasic acid, tartaric acid or its derivatives and citric acid or its derivatives can be used individually or as a combination of two or more compounds. An effective content of the dibasic acid in a fixer is 0.005 mol/l or more and the especially effective content is 0.01 mol/l to 0.03 mol/l.

Examples of citric acid and its derivatives effective in the invention include citric acid, sodium citrate, potassium citrate, and the like.

Further, a preservative (for example, a sulfite or a bisulfite), a pH buffering agent (for example, acetic acid or boric acid), a pH adjusting agent (for example, ammonia or sulfuric acid), an agent to improve storage properties of image (for example, potassium iodide), and a chelating agent can be contained in the fixer, as required. As the developing solution has a high pH value, the above-mentioned buffering agent is used in an amount of about 10 to 40 g/l, preferably about 18 to 25 g/l.

The fixing temperature and the fixing time of the invention are the same as those in a conventional development process and are preferably about 20° to 50° C. and about 10 sec to 1 min, respectively.

Further, bactericides (for example, compounds described in H. Horiguchi, *Antibacterial and Antifungal Chemistry,* and in Japanese Patent Application (OPI) No. 115154/87, washing accelerators (for example, sulfites and the like), and chelating agents may be contained in washing water.

A photographic material after being developed and fixed according to the above-mentioned method is washed and dried. Washing is carried out to remove almost completely silver salts dissolved by fixing, and washing is carried out preferably at about 20° to 50° C. for about 10 seconds to 3 minutes. Drying is carried out at about 40° to 100° C. and the drying time varies with the ambient conditions but it is usually from about 5 seconds to 3 minutes and 30 seconds.

The silver halide photographic material of the invention provides a high $D_{max}$, so that even if, after formation of the image, it is subjected to a reduction treatment, the dot area is reduced but a high density is maintained.

As representative examples of reducing solution which may be used in the invention, there may be mentioned a so-called Farmer's reducing solution, a reducing solution of ferric salt of ethylenediaminetetraacetic acid, a reducing solution of potassium permanganate, an ammonium persulfate reducing solution (Kodak R-5), and a cerium (IV) salt reducing solution.

The invention will be described in detail referring to the following ion-limiting examples.

Unless otherwise indicated herein, all parts, percents, ratios and the like are by weight.

EXAMPLE 1

Emulsions A–E as shown below were prepared.

Emulsion A

An aqueous solution of silver nitrate and an aqueous solution containing a mixture of sodium chloride and potassium bromide and further containing $2.7\times10^{-7}$ mol of ammonium hexachlororhodate (III) and $4\times10^{-7}$ mol of potassium hexachloroiridate (III) each per mol of silver were simultaneously added to an aqueous solution of gelatin (having a pH value of 4.0 maintained at 50° C.) at a constant rate for 30 min, and a monodispersed silver chlorobromide emulsion (composition: 70 mol % of Cl) having an average grain size of 0.23 μm was prepared.

After the emulsion was washed with water according to a usual method to remove soluble salts, $4\times10^{-5}$ mol of sodium thiosulfate and $3.8\times10^{-5}$ mol of potassium chloroaurate each per mol of silver were added to the emulsion for chemical ripening-treatment. Further, an aqueous solution of potassium iodide corresponding to 0.1 mol % per mol of silver was added to the emulsion to apply a conversion-treatment to the surface of grains.

Emulsion B

A monodispersed silver chlorobromide emulsion (composition: 70 mol % of Cl) having an average grain size of 0.26 μm was prepared by the same method as in Emulsion A. After the emulsion was desalted similarly, $6\times10^{-5}$ mol of sodium thiosulfate per mol of silver was added to it for chemical ripening-treatment. Further, an aqueous solution of potassium iodide corresponding to 0.1 mol % per mol of silver was added to the emulsion to apply a conversion-treatment to the surface of grains.

Emulsion C

A monodispersed silver chlorobromide emulsion (composition: 90 mol % of Cl) having an average grain size of 0.28 μm was prepared by the same method as in Emulsion A. After the emulsion was desalted similarly, $4\times10^{-5}$ mol of sodium thiosulfate and $3.8\times10^{-5}$ mol of potassium chloroaurate each per mol of silver were added to it for chemical ripening-treatment. Further, an aqueous solution of potassium iodide corresponding to 0.1 mol % per mol of silver was added to the emulsion to apply a conversion treatment to the surface of the grains.

Emulsion D

An aqueous solution of silver nitrate and an aqueous solution of potassium bromide containing $2\times10^{-7}$ mol of ammonium hexachlororhodate (III) and $4\times10^{-7}$ mol of potassium hexachloroiridate (III) each per mol of silver were added simultaneously to an aqueous solution of gelatin maintained at 50° C. in the presence of ammonia for 60 min while the pAg value of the reaction solution was maintained at 7.8, and a monodispersed silver bromide emulsion having an average grain size of 0.25 μm was prepared. After the emulsion was desalted by a conventional flocculation process, $3.5\times10^{-5}$ mole of sodium thiosulfate and $2\times10^{-5}$ mole of potassium chloroaurate each per mol of silver were added to the emulsion for chemical ripening-treatment. Further, an aqueous solution of potassium iodide corresponding to 0.1 mol % per mol of silver was added to the emulsion to apply a conversion-treatment to the surface of grains.

Emulsion E

A monodispersed silver bromide emulsion having an average grain size of 0.25 μm was prepared by the same method as in emulsion D except that the rhodium salt was omitted. After the emulsion was desalted, $6\times10^{-5}$ mol of sodium thiosulfate per mol of silver added to it for chemical ripening-treatment. Further, an aqueous solution of potassium iodide corresponding to 0.1 mol % per mol of silver was added to the emulsion to apply a conversion treatment to the surface of grains. Characteristics of emulsions A–E were summarized in Table 1.

TABLE 1

| Emulsion | Grain size (μm) | Dispersion coefficient (%) | Chemical sensitization | |
|---|---|---|---|---|
| | | | Sulfur | Gold |
| A (Invention) | 0.23 | 13 | Yes | Yes |
| B | 0.26 | 13 | Yes | No |
| C (Invention) | 0.28 | 12 | Yes | Yes |
| D (Invention) | 0.25 | 10 | Yes | Yes |
| E | 0.25 | 10 | Yes | No |

Dispersion coefficient: $\frac{\text{Standard deviation}}{\text{Average grain size}} \times 100\ (\%)$ These emulsions each were divided into 20 sections and $1\times10^{-3}$ mol of 5 {3-(4-sulfobutyl)-5-chloro-2-oxazolidylidene}-1-hydroxyethyl-3-(2-pyridyl)-2-thiohydantoin as a sensitizing dye per mol of Ag, 4-hydroxy-6-methyl-1,3,3a,7-tetrazaindene and hydroquinone as stabilizers, a polyethyl acrylate dispersion for the purpose of improving a film quality, and 1,3-divinylsulfonyl-2-propanol as a hardening agent, and further, a compound of the general formula (I) of the invention and a compound of the general formula (II) of the invention each in an amount as shown in Table 2 were added to each of the above-mentioned sections to prepare 20 photographic emulsions.

Further, polymethyl methacrylate particles having an average particle size of 2.5 μm and methanol silica as matting agents, a silicone oil as a lubricant, and sodium p-dodecylbenzenesulfonate as a coating aid were added to a gelatin solution to prepare a gelatin coating composition for coating as a surface protective layer. Each photographic emulsion prepared as mentioned above and the above-mentioned gelatin coating were applied to a polyethylene terephthalate support by a simultaneous coating method to prepare a photographic material having a silver coating weight of 3.3 g/m$^2$, and thus sample Nos. 1–20 were prepared.

Each sample was exposed and then developed so that photographic characteristics of the samples may be compared.

Experimental conditions and evaluating methods which provide the data shown as "photographic characteristics" 1–3 Table 2 below) are as follows.

Photographic characteristics 1 show a result of the treatment of the sample with a developing solution A as set forth below at 34° C. for 30 seconds by use of an automatic developing machine FG-660F (a product of Fuji Photographic Film Co. Ltd.). Photographic characteristics 2 show a result of a treatment of sample by the same method as in photographic characteristics 1 after 200 sheets of Fuji lith orthochromatic film GO-100 large entire size (50.8 cm ×61 cm) for 100% blackening have been treated with the developing solution A.

Photographic characteristics 3 show a result of the same treatment of samples as in photographic characteristics 1 but where the developing solution A as set forth below has been allowed to stand for 1 week without replenishment and subjected to fatigue with passage of time, during which the pH value of solution A has increased by 0.05 and the concentration of sulfite ions has been reduced to 50% of that in a fresh developing solution.

Relative sensitivity of photographic material was the reciprocal of the exposure necessary to give a density of 1.5 when developed at 34° C. for 30 seconds, and was represented by a relative value of the reciprocal taking the reciprocal of sample No. 1 as 100.

Black peppers were evaluated by observation through a microscope and were divided into 5 classes. "5" represented the best quality and "1" the worst quality. "5" and "4" were usable practically, "3" was bad but barely usable practically, and "2" and "1" were unusable practically. An intermediate between "1" and "2" was evaluated as "1.5".

| Developing solution A | |
|---|---|
| Hydroquinone | 45.0 g |
| N-methyl-p-aminophenol ½ sulfate | 0.8 g |
| Sodium hydroxide | 18.0 g |
| Potassium hydroxide | 55.0 g |
| 5-sulfosalicyclic acid | 45.0 g |
| Boric acid | 25.0 g |
| Potassium sulfite | 110.0 g |
| Ethylenediaminetetraacetic acid disodium salt | 1.0 g |
| Potassium bromide | 6.0 g |
| 5-Methyl-benzotriazole | 0.6 g |
| n-Butyl diethanolamine | 15.0 g |
| Water to make | 1 liter |
| | (pH = 11.6) |

dichloro-9-ethyl-3,3'-bis(3-sulfopropyl)-oxacarbocyanine, were added to an emulsion A used in Example 1 and further, compounds of general formula (I) and of general formula (II) in the invention and comparative compounds (1)–(3) shown below, were each added in an amount as shown in Table 3 to prepare 21 sample emulsions. Each sample emulsion and the s same protective layer as in Example 1 were applied to a support by a simultaneous coating method to prepare a photographic material having a silver coating weight of 3.3 g/m², and thus sample Nos. 21–41 were prepared. They were evaluated in the same way as in Example 1.

The results are given in Table 3 below. (Comparative compounds)

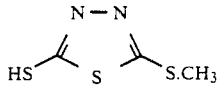

(1)

(2)

TABLE 2

| Sample No. | Emulsion | Compound (I) Type | Compound (I) Added Amount (mol/mol Ag) | Compound (II) Type | Compound (II) Added Amount (mol/mol Ag) | Photographic Characteristics 1 A | γ | $D_{max}$ | B | Photographic Characteristics 2 A | γ | $D_{max}$ | B | Photographic Characteristics 3 A | γ | $D_{max}$ | B |
|---|---|---|---|---|---|---|---|---|---|---|---|---|---|---|---|---|---|
| 1 | A | — | — | (II)-8 | $1 \times 10^{-4}$ | 100 | 17 | 5.5 | 3 | 95 | 16.0 | 5.2 | 5 | 110 | >20 | 5.0 | 1.5 |
| 2* | " | (I)-4 | $2.5 \times 10^{-4}$ | " | " | 95 | 16.5 | 5.4 | 4.5 | 91 | 15.0 | 5.1 | 5 | 102 | 17 | 5.3 | 3.5 |
| 3* | " | " | $5 \times 10^{-4}$ | " | " | 91 | 16 | 5.4 | 5.0 | 87 | 15.0 | 5.0 | 5 | 95 | 16.5 | 5.2 | 4 |
| 4* | " | (I)-1 | $5 \times 10^{-4}$ | " | " | 100 | 17.0 | 5.4 | 4.5 | 95 | 15.5 | 5.2 | 5 | 105 | 18 | 5.4 | 4 |
| 5 | B | — | — | " | " | 100 | 15.5 | 5.4 | 4 | 89 | 13 | 4.4 | 5 | 102 | 17.5 | 5.0 | 2 |
| 6 | " | (I)-4 | $2.5 \times 10^{-4}$ | " | " | 91 | 15.5 | 5.3 | 5 | 78 | 13 | 4.3 | 5 | 100 | 17.9 | 5.1 | 4 |
| 7 | " | " | $5 \times 10^{-4}$ | " | " | 85 | 15.0 | 5.2 | 5 | 69 | 13.5 | 4.1 | 5 | 98 | 17.0 | 5.1 | 4 |
| 8 | " | (I)-1 | $5 \times 10^{-4}$ | " | " | 93 | 16.0 | 5.3 | 5 | 78 | 14.0 | 4.4 | 5 | 107 | 18.2 | 5.2 | 4 |
| 9 | C | — | — | " | " | 98 | 17.5 | 5.5 | 3 | 93 | 16.0 | 5.2 | 4 | 105 | 18.0 | 5.4 | 1 |
| 10* | " | (I)-4 | $2.5 \times 10^{-4}$ | " | " | 93 | 17.0 | 5.5 | 3.5 | 87 | 15.4 | 5.2 | 4 | 100 | 18.2 | 5.4 | 2.5 |
| 11* | " | " | $5 \times 10^{-4}$ | " | " | 91 | 16.8 | 5.4 | 3.5 | 83 | 15.0 | 5.0 | 4.5 | 98 | 17.8 | 5.4 | 3.0 |
| 12* | " | (I)-1 | $5 \times 10^{-4}$ | " | " | 98 | 17.3 | 5.4 | 3.5 | 91 | 15.6 | 5.2 | 4.5 | 105 | 18.0 | 5.3 | 3.0 |
| 13 | D | — | — | " | $1.1 \times 10^{-4}$ | 105 | 16.5 | 5.3 | 4 | 98 | 14.0 | 4.9 | 5 | 115 | 17.8 | 5.0 | 1 |
| 14* | " | (I)-4 | $2.5 \times 10^{-4}$ | " | " | 100 | 17.2 | 5.2 | 4 | 93 | 14.8 | 4.8 | 4.5 | 105 | 18.0 | 4.8 | 3 |
| 15* | " | " | $5 \times 10^{-4}$ | " | " | 95 | 15.6 | 5.0 | 4.5 | 87 | 14.2 | 4.6 | 5 | 100 | 16.2 | 4.5 | 3.5 |
| 16* | " | (I)-1 | $5 \times 10^{-4}$ | " | " | 100 | 16.4 | 5.2 | 4.5 | 93 | 13.6 | 4.8 | 4.5 | 107 | 17.0 | 4.7 | 3.5 |
| 17 | E | — | — | " | $1.2 \times 10^{-4}$ | 102 | 16.0 | 5.2 | 5 | 91 | 13.5 | 4.8 | 5 | 107 | 17.0 | 4.9 | 2.5 |
| 18 | " | (I)-4 | $2.5 \times 10^{-4}$ | " | " | 98 | 16.5 | 5.0 | 3 | 91 | 13.8 | 4.3 | 5 | 102 | 17.8 | 4.6 | 4 |
| 19 | " | " | $5 \times 10^{-4}$ | " | " | 93 | 13.5 | 4.6 | 5 | 83 | 11.5 | 3.9 | 5 | 100 | 14.8 | 4.5 | 5 |
| 20 | " | (I)-1 | $5 \times 10^{-4}$ | " | " | 98 | 14.8 | 4.8 | 5 | 89 | 12.0 | 4.1 | 5 | 105 | 15.6 | 4.5 | 4 |

*present invention
A: Relative Sensitivity
B: Black Pepper

As is seen from Table 2, samples of the invention, that is, Sample Nos. 2, 3, 4, 10, 11, 12, 14, 15, and 16 give good results even with a developing solution having a lowered pH value after finishing of treatment of a large number of films (see photographic characteristics 2) or even with a developing solution having an increased pH value due to fatigue with passage of time (see photographic characteristics 3). In contrast to the samples, comparative samples have defects such as a lowering in $D_{max}$ and a lowering in γ (see photographic characteristics 2) or an increase in black peppers (see photographic characteristics 3).

EXAMPLE 2

The same compounds as in Example 1, with the exception that the sensitizing dye was changed to 5,5'-

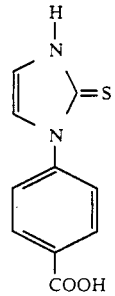

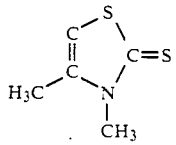

(3)

TABLE 3

| Sample No. | Emulsion | Compound (I) Type | Compound (I) Added Amount (mol/mol Ag) | Compound (II) Type | Compound (II) Added Amount (mol/mol Ag) | Photographic Characteristics 1 A | Photographic Characteristics 1 γ | Photographic Characteristics 1 $D_{max}$ | Photographic Characteristics 1 B | Photographic Characteristics 2 A | Photographic Characteristics 2 γ | Photographic Characteristics 2 $D_{max}$ | Photographic Characteristics 2 B | Photographic Characteristics 3 A | Photographic Characteristics 3 γ | Photographic Characteristics 3 $D_{max}$ | Photographic Characteristics 3 B |
|---|---|---|---|---|---|---|---|---|---|---|---|---|---|---|---|---|---|
| 21 | A | — | — | (II)-9 | $1 \times 10^{-4}$ | 93 | 16.6 | 5.4 | 4.5 | 89 | 14.8 | 5.0 | 5 | 100 | 19.0 | 5.3 | 2 |
| 22 | " | — | — | " | $1.5 \times 10^{-4}$ | 100 | 18.0 | 5.5 | 3.5 | 95 | 16.0 | 5.2 | 5 | 102 | >20 | 5.0 | 1 |
| 23* | " | (I)-4 | $1 \times 10^{-4}$ | " | " | 100 | 18.0 | 5.5 | 4.5 | 98 | 16.0 | 5.1 | 5 | 102 | 19.0 | 5.3 | 3.5 |
| 24* | " | " | $2.5 \times 10^{-4}$ | " | " | 95 | 17.4 | 5.4 | 4.5 | 93 | 15.8 | 5.0 | 5 | 98 | 18.0 | 5.3 | 4 |
| 25* | " | " | $5 \times 10^{-4}$ | " | " | 91 | 16.8 | 5.3 | 5 | 87 | 14.8 | 5.0 | 5 | 95 | 17.2 | 5.2 | 4 |
| 26* | " | (I)-5 | $1 \times 10^{-4}$ | " | " | 98 | 17.6 | 5.4 | 4.5 | 95 | 16.0 | 5.2 | 5 | 102 | 19.0 | 5.2 | 3.5 |
| 27* | " | " | $2.5 \times 10^{-4}$ | " | " | 95 | 17.0 | 5.3 | 4.5 | 91 | 15.6 | 5.1 | 5 | 98 | 18.0 | 5.0 | 4 |
| 28* | " | " | $5 \times 10^{-4}$ | " | " | 93 | 16.0 | 5.2 | 5 | 89 | 14.8 | 4.8 | 5 | 98 | 17.4 | 5.0 | 4 |
| 29* | " | (I)-12 | $1 \times 10^{-4}$ | " | " | 95 | 18.0 | 5.3 | 4 | 91 | 17.0 | 5.1 | 5 | 102 | 18.5 | 5.2 | 3.5 |
| 30* | " | " | $2.5 \times 10^{-4}$ | " | " | 91 | 16.4 | 5.3 | 4.5 | 87 | 16.0 | 5.0 | 5 | 98 | 17.0 | 5.0 | 4 |
| 31* | " | " | $5 \times 10^{-4}$ | " | " | 87 | 15.8 | 5.1 | 4.5 | 81 | 15.0 | 4.9 | 5 | 95 | 16.8 | 5.0 | 4 |
| 32* | " | (I)-16 | $1 \times 10^{-4}$ | " | " | 100 | 18.0 | 5.5 | 4 | 95 | 17.2 | 5.2 | 5 | 102 | 18.0 | 4.9 | 3 |
| 33* | " | " | $2.5 \times 10^{-4}$ | " | " | 98 | 17.5 | 5.4 | 4.5 | 91 | 15.3 | 4.9 | 5 | 98 | 16.2 | 4.9 | 3.5 |
| 34* | " | " | $5 \times 10^{-4}$ | " | " | 93 | 17.0 | 5.2 | 5 | 87 | 15.0 | 4.8 | 5 | 87 | 16.0 | 4.7 | 3.5 |
| 35 | " | (1) | $1 \times 10^{-4}$ | " | " | 98 | 16.0 | 5.3 | 4 | 87 | 13.2 | 4.6 | 5 | 93 | 16.2 | 4.7 | 3 |
| 36 | " | " | $2.5 \times 10^{-4}$ | " | " | 91 | 14.8 | 5.1 | 5 | 76 | 11.8 | 4.4 | 5 | 85 | 15.4 | 4.6 | 3.5 |
| 37 | " | " | $5 \times 10^{-4}$ | " | " | 83 | 14.0 | 5.0 | 5 | 66 | 10.0 | 4.2 | 5 | 76 | 14.0 | 4.4 | 4 |
| 38 | " | (2) | $1 \times 10^{-4}$ | " | " | 95 | 16.8 | 5.3 | 5 | 83 | 13.8 | 4.6 | 5 | 100 | 17.0 | 4.8 | 3 |
| 39 | " | " | $2.5 \times 10^{-4}$ | " | " | 87 | 14.0 | 5.0 | 5 | 76 | 10.6 | 4.4 | 5 | 95 | 15.4 | 4.5 | 4 |
| 40 | " | (3) | $1 \times 10^{-4}$ | " | " | 98 | 17.0 | 5.5 | 3 | 91 | 15.5 | 5.2 | 4.5 | 102 | 17.5 | 5.0 | 1.5 |
| 41 | " | " | $2.5 \times 10^{-4}$ | " | " | 95 | 16.5 | 5.4 | 3.5 | 87 | 14.5 | 5.0 | 4.5 | 100 | 16.5 | 4.9 | 1.5 |

*present invention
A: Relative Sensitivity
B: Black Pepper

As is seen from Table 3, sample Nos. 23–34 of the invention gave good results in both photographic characteristics 2 and 3 as compared with comparative sample Nos. 21, 22, and 35–41.

EXAMPLE 3

Even when (II)–7, (II)–18, (II)–25, or (II)–40 of the invention were used in place of (II)–8 of the invention in Example 1, samples of emulsion A so modified gave results.

EXAMPLE 4

Samples were prepared in the same manner as Example 1, sample No. 2, except that compound (II)–4, (II)–17, or (II)–23 was used in place of compound (II)–8. These samples showed good photographic characteristics similar to sample No. 2.

While the invention has been described in detail and with reference to specific embodiments thereof, it will be apparent to one skilled in the art that various changes and modifications can be made therein without departing from the spirit and scope thereof.

What is claimed is:

1. A negative type silver halide photographic material which comprises a support having provided thereon at least one silver halide emulsion layer containing silver halide grains sensitized with gold and sulfur sensitizers, said emulsion layer or at least one other hydrophilic colloid layer containing at least one high contrast-imparting hydrazine derivative and at least one compound represented by the following general formula (I):

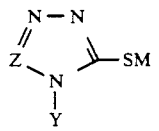

(I)

wherein Z represents N or C—X wherein X represents a substituted or unsubstituted alkyl or aryl group, Y represents a substituted or unsubstituted alkyl or aryl group, and M represents a hydrogen atom, a metallic atom, or ammonium which may be substituted; wherein said hydrazine derivative is represented by the general formula (II):

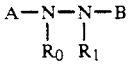

wherein A represents a substituted or unsubstituted aliphatic or aromatic group, B represents a formyl group, an acyl group, an alkysulfonyl group, an arylsulfonyl group, an arylsulfinyl group, a carbomoyl group, a sulfomoyl group, an alkoxycarbonyl group, an aryloxycarbonyl group, a sulfinamoyl group, an alkoxysulfonyl group, a thioacyl group, a thiocarbamoyl group, or a heterocyclic group; and both $R_0$ and $R_1$ represents hydrogen atoms or one of $R_0$ and $R_1$ represents a hydrogen atom and the other represents a substituted or unsubstituted alkylsulfonyl group, a substituted or unsubstituted arylsulfonyl group, or a substituted or unsubstituted acyl group; and B, $R_1$ and the nitrogen atom to which they are bonded may form a partial structure —N=C< of hydrazone.

2. A negative type silver halide photographic material as claimed in claim 1, wherein said compound represented by the general formula (I) is contained in an amount of $1\times10^{-6}$ to $5\times10^{-2}$ mol per mol of total silver halide.

3. A negative type silver halide photographic material as claimed in claim 1, wherein said compound represented by the general formula (I) is contained in an amount of $1\times10^{-5}$ to $2\times10^{-2}$ mol per mol of total silver halide.

4. A negative type silver halide photographic material as claimed in claim 1, wherein said hydrazine derivative represented by the general formula (II) is contained in an amount of $1\times10^{-6}$ to $5\times10^{-2}$ mol per mol of total silver halide.

5. A negative type silver halide photographic material as claimed in claim 1, wherein said hydrazine derivative represented by the general formula (II) is contained in an amount of $1\times10^{-5}$ to $2\times10^{-2}$ mol per mol of total silver halide.

6. A negative type silver halide photographic material as claimed in claim 1, wherein the amounts of sulfur sensitizer and gold sensitizer are $1\times10^{-3}$ to $1\times10^{-5}$ mol per mol of silver each and the ratio of sulfur sensitizer to gold sensitizer is 1:3 to 3:1 by mol.

7. A negative type silver halide photographic material as claimed in claim 1, wherein the amounts of sulfur sensitizer and gold sensitizer are $1\times10^{-3}$ to $1\times10^{-5}$ mol per mol of silver each and the ratio of sulfur sensitizer to gold sensitizer is 1:2 to 2:1 by mol.

8. A negative type silver halide photographic material as claimed in claim 1, wherein said compound of the general formula (I) and said hydrazine derivatine of the general formula (II) are contained in the same layer.

9. A method of forming a superhigh contrast negative image comprising developing an imagewise exposed silver halide photographic material with a developing solution containing sulfite ions in an amount of at least about 0.15 mol per liter and having a pH of 10.5 to 12.3, wherein said silver halide photographic material comprises a support having provided thereon at least one silver halide emulsion layer containing a silver halide which has been subjected to gold sensitization and sulfur sensitization, and said silver halide emulsion layer or at least one other hydrophilic colloid layer contains at least one high contrast-imparting hydrazine derivative and at least one compound represented by the following general formula (I):

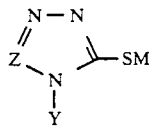

(I)

wherein Z represents N or C—X wherein X represents a substituted or unsubstituted alkyl or aryl group, Y represents a substituted or unsubstituted alkyl or aryl group, and M represents a hydrogen atom, a metallic atom, or ammonium which may be substituted; wherein said hydrazine derivative is represented by the general formula (II):

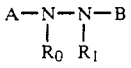

(II)

wherein A represents a substituted or unsubstituted aliphatic or aromatic group, B represents a formyl group, an acyl group, an alkysulfonyl group, an arylsulfonyl group, an arylsulfinyl group, a carbamoyl group, a sulfamoyl group, an alkoxycarbonyl group, an aryloxycarbonyl group, a sulfinamoyl group, an alkoxysulfonyl group, a thioacyl group, a thiocarbamoyl group, or a heterocyclic group; and both $R_0$ and $R^1$ represents hydrogen atoms or one of $R_0$ and $R_1$ represents a hydrogen atom and the other represents a substituted or unsubstituted alkylsulfonyl group, a substituted or unsubstituted arylsulfonyl group, or a substituted or unsubstituted acyl group; and B, $R_1$ and the nitrogen atom to which they are bonded may form a partial structure —N=C< of hydrazone.

* * * * *